US007393463B2

(12) United States Patent
Ulicny et al.

(10) Patent No.: US 7,393,463 B2
(45) Date of Patent: Jul. 1, 2008

(54) HIGH TEMPERATURE MAGNETORHEOLOGICAL FLUID COMPOSITIONS AND DEVICES

(75) Inventors: John C. Ulicny, Oxford, MI (US); Mark A. Golden, Washington, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 356 days.

(21) Appl. No.: 11/229,216

(22) Filed: Sep. 16, 2005

(65) Prior Publication Data

US 2007/0063166 A1 Mar. 22, 2007

(51) Int. Cl.
*H01F 1/44* (2006.01)

(52) U.S. Cl. ..... 252/62.52

(58) Field of Classification Search ..... 252/62.52
See application file for complete search history.

(56) References Cited

U.S. PATENT DOCUMENTS

| | | | | |
|---|---|---|---|---|
| 2,990,485 | A * | 6/1961 | Lee | 310/178 |
| 3,984,715 | A * | 10/1976 | Kullmann et al. | 310/219 |
| 6,637,387 | B1 | 10/2003 | Gecim et al. | 123/90.16 |
| 2004/0051287 | A1 | 3/2004 | Parizat et al. | 280/741 |

FOREIGN PATENT DOCUMENTS

WO WO 00/54928 A1 9/2000

OTHER PUBLICATIONS

R.C. Kanu et al; "Effects of DC and AC Electric Fields on the Response of Electrorheological Fluids Conprising Cylindrical PBZT Particles"; Progress in Electrorheology; K.O. Havelka and F.E. Filisko, eds., Plenum, NY, 1995 pp. 303-332.

R.C. Kanu et al; "Studies of ER FLuids Featuring Rodlike Particles"; Int. J. Mod. Phys. B, vol. 10, 2925-2932 (1996).

W.K. Toboldt et al., "Automotive Encyclopedia", Goodheart-Willcox, IL, 2000; pp. 98-102.

R. Ito et al., "MR Fluid of Liquid Gallium Dispersing Magnetic Particles", International Journal of Modern Physics B, vol. 19, Nos. 7, 8 & 9 (2005) pp. 1430-1436.

* cited by examiner

*Primary Examiner*—C. Melissa Koslow

(57) ABSTRACT

A magnetorheological fluid composition comprising magnetizable particles in a liquid metal carrier fluid, wherein the liquid metal carrier fluid comprises a metal, a metal alloy, or a solder composition having a melting point from about −40° C. to about 300° C., a boiling point greater than 300° C., and a viscosity greater than about 0.1 centipoise (cp) at the melting point of the liquid based metal carrier fluid. The magnetizable particles can comprise low aspect ratio magnetizable particles, high aspect magnetizable particles, or a combination thereof. Also disclosed herein are high temperature magnetorheological devices operating at temperatures greater than 100° C., and comprising the magnetorheological fluid composition.

15 Claims, No Drawings

HIGH TEMPERATURE MAGNETORHEOLOGICAL FLUID COMPOSITIONS AND DEVICES

BACKGROUND

This disclosure relates to magnetorheological fluid compositions, and more particularly to high yield stress magnetorheological (MR) fluid compositions.

Fluid compositions that undergo a change in apparent viscosity in the presence of a magnetic field are referred to as Bingham magnetic fluids or magnetorheological fluids. Magnetorheological fluids generally include low aspect ratio magnetizable particles dispersed or suspended in a carrier fluid. The low aspect ratio magnetizable particles have an aspect ratio less than 1.5, and more typically have an aspect ratio of about 1. In the presence of a magnetic field, the low aspect magnetizable particles become polarized and are thereby organized into chains of particles within the carrier fluid. The chains of particles act to increase the apparent viscosity or flow resistance of the fluid composition resulting in the development of a solid mass having a yield stress that must be exceeded to induce onset of flow of the magnetorheological fluid. When the flow of the fluid composition is restricted as a result of orientation of the particles into chains, the fluid composition is said to be in its "on state". The force required to exceed the yield stress is referred to as the "yield strength". In the absence of a magnetic field, the particles return to a disorganized or free state and the apparent viscosity or flow resistance of the fluid composition is then correspondingly reduced. The state occupied by the composition in the absence of a magnetic field is referred to as the "off-state".

The carrier fluids employed in the MR fluid composition form the continuous phase in which the magnetic particles are dispersed or suspended. Prior art carrier fluids are generally organic. Specific examples of prior art carrier fluids are natural fatty oils, mineral oils, poly α-olefins, polyphenylethers, polyesters (such as perfluorinated polyesters, dibasic acid esters and neopentylpolyol esters), phosphate esters, synthetic cycloparaffin oils and synthetic paraffin oils, unsaturated hydrocarbon oils, monobasic acid esters, glycol esters and ethers (such as polyalkylene glycol), synthetic hydrocarbon oils, perfluorinated polyethers, halogenated hydrocarbons, or the like, or a combination comprising at least one of the foregoing carrier fluids. Because of the relatively low specific gravity of these carrier fluids, the MR fluid compositions typically include a suspending agent such as fumed silica, clay, nanoparticles or the like. Optionally, particle settling in these types of carrier fluids can be managed through the use of other additives or treatments, which allow for re-suspension of the particles.

The prior art carrier fluids are generally unsuitable for high temperature and high yield stress applications, wherein the operating temperatures of the device using the MR fluid composition exceed 100° C. or more. At these temperatures, current MR fluid compositions can deteriorate causing changes in performance during operation of the device. For example, a change in yield stress in the on-state or an increase in viscosity in the off-state, among others, typically occurs. The amount of deterioration generally depends on shear rate, temperature, and duration. In addition, because these fluids generally are of low specific gravity, the compositions can exhibit unacceptable particle settling. As such, current MR fluid compositions are generally unsuitable for such high temperature applications as a clutch application for a vehicle alternator, which can result in the MR fluid composition being exposed to temperatures of about 200 to about 250° C. (with transients at about 450° C. or more); a transmission clutch that generally operates at a temperature of 100° C. or more; a variable valve actuator disposed in the exhaust stems near the cylinder head, wherein the MR fluid composition can be exposed to operating temperatures of about 400-500° C.; and the like.

Desirable MR fluid properties for the aforementioned high temperature applications include, among others, a low viscosity, a high temperature capability, and a low tendency for particle settling. It is difficult to achieve most, if not all, of these properties with the prior art carrier fluids. For example, silicone fluids offer better heat resistance relative to other types of prior art carrier fluids but have never been found to work satisfactorily in high temperature applications requiring rapid (on the order of milliseconds) and reversible changes in yield stress such as the clutch applications described above. Moreover, silicone fluids, operating at high temperature conditions, are prone to crosslinking, which directly affects the off-state properties and operating lifetimes.

Accordingly, there is a need for improved high temperature MR fluid compositions that can meet the needs of devices used for high temperature applications.

BRIEF SUMMARY

Disclosed herein is a magnetorheological fluid composition comprising magnetizable particles; and a liquid metal carrier fluid, wherein the liquid metal carrier fluid comprises a metal, a metal alloy, or a solder composition having a melting point from about −40° C. to about 300° C., a boiling point greater than 300° C., and a viscosity greater than about 0.1 centipoise (cp) at the melting point of the liquid based metal carrier fluid.

In another embodiment, a high temperature magnetorheological fluid device, operating at a temperature greater than 100° C. comprises a magnetorheological fluid composition comprising magnetizable particles; and a liquid metal carrier fluid, wherein the liquid metal carrier fluid comprises a metal, a metal alloy, or a solder composition having a melting point from about −40° C. to about 300° C., a boiling point greater than 300° C., and a viscosity greater than about 0.1 centipoise (cp) at the melting point of the liquid based metal carrier fluid.

In another embodiment, a magnetorheological fluid composition comprises high aspect ratio magnetizable particles; and a liquid metal carrier fluid comprising gallium.

The above described and other features are exemplified by the following detailed description.

DETAILED DESCRIPTION

Disclosed herein are magnetorheological (MR) fluid compositions that advantageously provide a low viscosity, a high temperature capability, and a low tendency for particle settling. The MR fluid compositions generally include magnetizable particles disposed in a liquid metal based carrier fluid, thereby providing a replacement for hydrocarbon based carrier fluids. The term liquid metal based carrier fluid is to be accorded its ordinary meaning and is meant to include metals, metal alloys, and/or various solder compositions that are in liquid form at the intended operating ranges for the high temperature application. By high temperatures, it is generally meant that the MR device is exposed to and/or is operating at temperatures greater than 100° C.

The liquid based metal, (e.g., metal, metal alloy, or solder composition) preferably has a melting point of about −40° C. to about 300° C., a boiling point greater than 300° C., a viscosity greater than about 0.1 centipoise (cp) at the melting point of the liquid based metal, and a negligible vapor pressure at the intended operating pressures. In one embodiment, the melting point is greater than 20° C. to about 250° C., the boiling point greater than 500° C., and the viscosity is greater than about 2 cp at the melting point of the liquid based metal. For example, a suitable metal is gallium (neat), which has a melting point of about 30° C., a boiling point of about 2,200° C., a viscosity less than 2 centipoise (cp), at its melting point, and a negligible vapor pressure below temperatures less than 900° C. Advantageously, gallium metal also has a specific gravity of about 6.1, which can help minimize particle settling. For comparison, a typical hydrocarbon based fluid has a melting point of −40° C. a boiling point of 390° C., a viscosity of 4 cp at 100° C., a specific gravity of about 0.8, and a significant vapor pressure above 200° C.

Suitable neat liquid based metals include lithium, sodium, potassium, rubidium, cesium, francium, beryllium, mercury, indium, tin, gallium, and the like. In addition, various metal alloy and solder compositions are contemplated. Suitable metal alloy and solder compositions can include various combinations of lithium, sodium, potassium, rubidium, cesium, francium, beryllium, mercury, indium, tin, gallium, zinc, bismuth, lead, cadmium, silver, copper, gold, antimony, germanium, nickel, titanium, niobium, zirconium, aluminum, boron, silicon, and combinations comprising at least one of the foregoing. In one embodiment, the metal alloy is a eutectic mixture, which contains 68-69 wt.-% gallium, 21-22 wt.-% indium and 9.5-10.5 wt.-% tin. The eutectic mixture can, only include a small degree of impurity such as lead or zinc of less than 0.001 wt. %. preferably less than 0.0001 wt. %. The eutectic mixture has a low melting point of approx. −19.5° C. under normal pressure and atmospheric conditions. Furthermore, the vaporization point is above 1800° C.

The metal alloy and solder compositions can be amorphous or crystalline when in the solid state. Examples of suitable metal alloys and solder compositions and their melting points are presented in Table 1. The list is intended to be exemplary and non-limiting.

TABLE 1

| Composition | Melting Point (° C.) |
|---|---|
| 52In—48Sn | 118 |
| 97In—3Ag | 143 |
| 62Sn—36Pb-2 | 179 |
| 5Sn—95Pb | 30 |
| 45Sn—55Pb | 204 |
| 50In—50Pb | 209 |
| 96.5Sn—3.5Ag | 221 |
| 80In—15Pb—5Ag | 154 |
| 37.5Pb—37.5Sn—25In | 181 |
| 49Bi—18Pb—18In—15Sn | 69 |
| 61.7In—30.8Bi—7.5Cd | 61.5 |
| 95Ga—5In | 25 |

The magnetizable particles of the MR fluid composition are comprised of, for example, paramagnetic, superparamagnetic, ferromagnetic compounds, or a combination comprising at least one of the foregoing compounds. Examples of specific magnetizable particles are particles comprised of materials such as iron, iron oxide, iron nitride, iron carbide, carbonyl iron, chromium dioxide, low carbon steel, silicon steel, nickel, cobalt, or the like, or a combination comprising at least one of the foregoing. The iron oxide includes all forms of pure iron oxide, such as, for example, $Fe_2O_3$ and $Fe_3O_4$, as well as those containing small amounts of other elements, such as, manganese, zinc or barium. Specific examples of iron oxide include ferrites and magnetites. In addition, the magnetizable particles can be comprised of alloys of iron, such as, for example, those containing aluminum, silicon, cobalt, nickel, vanadium, molybdenum, chromium, tungsten, manganese, copper, or a combination comprising at least one of the foregoing metals.

The magnetizable particles can comprise low aspect ratio particles, high aspect ratio particles, or a combination comprising a mixture of high and low aspect ratio magnetizable particles as may be desired for different applications. Advantageously, because the specific gravity of the liquid based metal is relatively high (typically greater than about 5 $gm/cm^3$) compared to most hydrocarbon-based fluids (typically less than about 2 gm/cm 3), the MR fluid composition may not need a suspending agent.

The magnetizable particles can also be comprised of specific iron-cobalt and iron-nickel alloys. The iron-cobalt alloys have an iron to cobalt ratio ranging from about 30:70 to about 95:5. In one embodiment, the iron-cobalt alloys can have an iron to cobalt ratio ranging from about 50:50 to about 85:15. The iron-nickel alloys have an iron to nickel ratio ranging from about 90:10 to about 99:1. In one embodiment, the iron-nickel alloys can have an iron to cobalt ratio ranging from about 94:6 to about 97:3.

The aforementioned iron-cobalt and iron-nickel alloys may also contain a small amount of additional elements, such as, for example, vanadium, chromium, or the like, in order to improve the mechanical properties of the alloys. These additional elements are typically present in an amount that is less than about 3.0% by weight, based on the total weight of the magnetizable particles.

The magnetizable particles are generally obtained from processes involving the reduction of metal oxides, grinding or attrition, electrolytic deposition, metal carbonyl decomposition, rapid solidification, or smelt processing. Examples of suitable metal powders that are commercially available are straight iron powders, reduced iron powders, insulated reduced iron powders, cobalt powders, or the like, or a combination comprising at least one of the foregoing metal powders. Alloy powders can also be used. A suitable example of an alloy powder is one comprising 48 wt. % iron, 50 wt. % cobalt and 2 wt. % vanadium from UltraFine Powder Technologies, for example.

Exemplary magnetizable particles are those that contain a majority of iron in any one of its chemically available forms. Carbonyl iron powders that are made by the thermal decomposition of iron pentacarbonyl are generally desirable for use in a MR fluid composition.

An exemplary low aspect ratio particle is one that has an aspect ratio of about 1. The low aspect ratio particles can optionally have interlocking structures. Examples of suitable low aspect ratio particles are spherical particles ellipsoidal particles, conical particles, cuboidal particles, polygonal particles, or the like. The low aspect ratio magnetizable particles generally have an average particle size of about 0.1 micrometers to about 500 micrometers. In one embodiment, the low aspect ratio magnetizable particles have an average particle size of about 1 micrometers to about 250 micrometers. In another embodiment, the low aspect ratio magnetizable particles have an average particle size of about 10 micrometers to about 100 micrometers. In yet another embodiment, the low aspect ratio magnetizable particles have an average particle size of about 20 micrometers to about 80 micrometers. The low aspect ratio magnetizable particles may have a bimodal or high particle size distributions. While not wanting to be bound by theory, it is believed the use of bimodal particle size distribution can provide MR fluids with lower off-states relative to particles having a single size distribution (applicable to high aspect ratio particles as well as low aspect ratio particles).

The high aspect ratio magnetizable particles are those having an aspect ratio of greater than 1.5. These high aspect ratio magnetizable particles may therefore exist in the form of whiskers, needles, rods, tubes, strands, elongated platelets, lamellar platelets, ellipsoids, wires, micro fibers, nanofibers and nanotubes, elongated fullerenes, or the like, or a combination comprising at least one of the foregoing. Like the low aspect ratio particles, the high aspect ratio magnetizable particles may also have interlocking structures. The high aspect ratio magnetizable particles may also have shapes that are combinations of the shapes of high aspect ratio particles and low aspect ratio particles. For example, a suitable example of a high aspect ratio magnetizable particle that has a combined shape is one where a spherical particle is disposed upon a high aspect ratio magnetizable particle, at any point along the length of the high aspect ratio particle. In one embodiment, where such magnetizable particles exist in aggregate form, an aggregate having an aspect ratio greater than 1.5 will also suffice.

In general the high aspect ratio magnetizable particles can have cross sections that have any desirable geometry. Examples of suitable geometries are square, rectangular, triangular, circular, elliptical, polygonal, or a combination comprising at least one of the foregoing geometries.

The high aspect ratio particles can be nanoparticles or particles having dimensions in the micrometer range. High aspect ratio nanoparticles are those having at least one average dimension that is less than or equal to about 1,000 nanometers. A suitable example of a nanoparticle is one having an average diameter size of less than or equal to about 500 nanometers. In one embodiment, it is desirable for the high aspect ratio nanoparticles to have at least one average dimension that is less than or equal to about 200 nanometers. In another embodiment, it is desirable for the high aspect ratio nanoparticles to have at least one average dimension that is less than or equal to about 100 nanometers. In yet another embodiment, it is desirable for the high aspect ratio nanoparticles to have at least one average dimension that is less than or equal to about 25 nanometers.

Micrometer sized high aspect ratio magnetizable particles are those having the smallest dimension greater than about 1 micrometer. In one embodiment, micrometer sized high aspect ratio magnetizable particles are those having the smallest dimension greater than or equal to about 10 micrometers. In another embodiment, micrometer sized high aspect ratio magnetizable particles are those having the smallest dimension greater than or equal to about 100 micrometers. In yet another embodiment, micrometer sized high aspect ratio magnetizable particles are those having the smallest dimension greater than or equal to about 1,000 micrometers.

As previously noted, the aspect ratio of the high aspect ratio magnetizable particles is greater than 1.5. In one embodiment, the aspect ratio of the high aspect ratio magnetizable particles is greater than 2. In another embodiment, the aspect ratio of the high aspect ratio magnetizable particles is greater than 5. In yet another embodiment, the aspect ratio of the high aspect ratio magnetizable particles is greater than 10. In yet another embodiment, the aspect ratio of the high aspect ratio magnetizable particles is greater than 100. In yet another embodiment, the aspect ratio of the high aspect ratio magnetizable particles is greater than 1,000. In yet another embodiment, the aspect ratio of the high aspect ratio magnetizable particles is greater than 10,000.

In another embodiment, the high aspect ratio magnetizable particles comprise machining chips although other sources for the particles are equally suitable. The term "machining chips" is to be accorded its ordinary and usual meaning, and includes, but is not intended to be limited, magnetizable shavings and chips obtained by a cutting tool applied to a magnetizable material. One advantage from the use of machining chips, among others, is that the machining chips are relatively inexpensive compared to low aspect ratio carbonyl powders, for example. The machining chips can be formed from relatively inexpensive magnetic materials such as cast iron, for example. By way of comparison, machining chips formed from cast iron have an estimated cost of about $0.70 per pound whereas conventional carbonyl iron powders typically cost about $6 per pound. Thus, the addition of the high aspect ratio magnetizable particles at the aforementioned dimensions can not only provide increased responsiveness but also a significant commercial advantage. Alternatively, the machining chips can be formed from magnetic alloys to provide even greater magnetization than more traditional materials such as low aspect ratio water atomized carbonyl iron powders having dimensions that are about three orders of magnitude smaller.

A lathe or like machine can be used as a suitable cutting tool to produce the machine chips from any magnetizable material or magnetic alloy. As will be appreciated by those in the art, the desired length (1 to 10 mm) can be obtained as a function of the depth of cut whereas the desired diameter (0.1-1 mm) can be obtained as a function of the rate of feed and geometry of the cutting tool.

The high aspect ratio particles can function as bridges and can contact the chains of the low aspect ratio particles, thereby increasing the yield stress of the MR fluid composition in the on-state. The high aspect ratio particles contact the low aspect ratio particles or a chain of low aspect ratio particles to create a chain of particles or a network of particles that can increase the viscosity at lower magnetic field strengths when compared with a MR fluid composition that contains only low aspect ratio particles. The increase in viscosity can be advantageously achieved with a smaller number of total magnetizable particles in the high aspect ratio MR fluid composition when compared with a MR fluid composition that contains only low aspect ratio particles. Since the increase in viscosity can be achieved with a smaller number of magnetizable particles, MR devices can be reduced in size when compared with prior art devices.

The number of magnetizable particles whether it contain low aspect ratio particles, high aspect ratio particles, or combinations thereof, in the MR fluid composition generally depends upon the desired magnetic activity and viscosity of the liquid metal fluid, but can be from about 0.01 to about 60 volume percent of the liquid metal based carrier fluid, based on the total volume of the MR fluid composition. In one embodiment, the number of magnetizable particles in the MR fluid composition can be from about 1.5 to about 50 volume percent, based on the total volume of the MR fluid composition.

In MR fluid compositions comprising both low aspect ratio and high aspect ratio particles, the weight ratio of the high aspect ratio magnetizable particles to the low aspect ratio magnetizable particles is about 100:1 to about 1:100. In one embodiment, the weight ratio of the high aspect ratio magnetizable particles to the low aspect ratio magnetizable particles is about 75:1 to about 1:75. In another embodiment, the weight ratio of the high aspect ratio magnetizable particles to the low aspect ratio magnetizable particles is about 50:1 to about 1:50. In yet another embodiment, the weight ratio of the high aspect ratio magnetizable particles to the low aspect ratio magnetizable particles is about 25:1 to about 1:25. An exemplary weight ratio of the high aspect ratio magnetizable particles to the low aspect ratio magnetizable particles is about 1:4.

The liquid metal based carrier fluid is generally present in an amount of about 50 to about 95 volume percent, based upon the total volume of the MR fluid composition. In one embodiment, the carrier fluid is generally present in an amount ranging from about 65 to about 80 volume percent, based upon the total volume of the MR fluid composition.

The MR fluid composition can optionally include other additives such as a low temperature solder flux. That is, a solder flux that is liquid at the intended operating temperatures. If present, these optional additives can be present in an amount of about 0.25 to about 10 volume percent, based upon the total volume of the magnetorheological fluid. In one embodiment, these optional additives can be present in an amount of about 0.5 to about 7.5 volume percent, based upon the total volume of the magnetorheological fluid.

An exemplary solder flux comprises 20-60 wt. % phosphate containing 50-60% by concentration of phosphoric acid, 10-30 wt. % organic acid, 1-20 wt. % of a Group VIII transition element, and 5-30 wt. % of a viscosity modifier.

Advantageously, the MR fluid composition including the liquid based metal carrier fluid can be used in high temperature applications. When this fluid is exposed to a magnetic field, the yield stress of the M fluid increases by several orders of magnitude. Thus increase in yield stress can be used to control the fluid coupling between two rotating members such as a clutch. This change in yield stress is rapid and reversible. Since the magnetic field can be rapidly controlled by the application of a current to the field coil, the yield stress of the fluid and thus the clutch torque, can be changed just as rapidly. By using the liquid based metal carrier fluid, a low viscosity, a high temperature capability, and a low tendency for particle settling is obtained. Moreover, the magnetizable particles and additives, if present, can be selected to be chemically unreactive within the environment provided by the liquid based metal carrier fluid, thereby providing the MR device with extended operating lifetimes.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the invention not be limited to the particular embodiment disclosed as the best mode contemplated for carrying out this disclosure.

What is claimed is:

1. A magnetorheological fluid composition comprising:

magnetizable particles; and a liquid metal carrier fluid, wherein the liquid metal carrier fluid comprises a metal selected from the group consisting of lithium, sodium, potassium, rubidium, cesium, francium, beryllium, mercury, indium, and tin, or a metal alloy, or a solder composition having a melting point from about −40° C. to about 300° C., a boiling point greater than 300° C., and a viscosity greater than about 0.1 centipoise (cp) at the melting point of the liquid based metal carrier fluid.

2. The composition of claim 1, wherein the metal alloy or the solder composition comprises lithium, sodium, potassium, rubidium, cesium, francium, beryllium, mercury, indium, tin, gallium, zinc, bismuth, lead, cadmium, silver, copper, gold, antimony, germanium, nickel, titanium, niobium, zirconium, aluminum, boron, silicon, and combinations comprising at least one of the foregoing.

3. The composition of claim 1, wherein the magnetizable particles comprise low aspect ratio magnetizable particles, high aspect ratio magnetizable particles, or a combination thereof.

4. The composition of claim 3, wherein the low aspect ratio magnetizable particles have an average particle size of about 0.1 micrometers to about 500 micrometers.

5. The composition of claim 3, wherein the high aspect ratio magnetizable particles comprise whiskers, needles, rods, chips, tubes, strands, elongated platelets, lamellar platelets, ellipsoids, wires, or a combination comprising at least one of the foregoing.

6. The composition of claim 3, wherein the high aspect ratio magnetizable particles comprise cross sectional geometries that are square, rectangular, triangular, circular, elliptical, polygonal, or a combination comprising at least one of the foregoing geometries.

7. The composition of claim 1, further comprising a soldering flux composition that is liquid at an intended operating temperature.

8. The composition of claim 3, wherein the high aspect ratio magnetizable particles and the low aspect ratio magnetizable particles are manufactured from iron, iron oxide, iron nitride, iron carbide, carbonyl iron, chromium dioxide, low carbon steel, silicon steel, nickel, cobalt, iron oxides that contain small amounts of manganese, zinc or barium; alloys of iron that contain aluminum, silicon, cobalt, nickel, vanadium, molybdenum, chromium, tungsten, manganese, copper, or a combination comprising at least one of the foregoing metals; iron-cobalt alloys having an iron to cobalt ratio ranging from about 30:70 to about 95:5; iron-nickel alloys having an iron to nickel ratio ranging from about 90:10 to about 99:1; or a combination comprising at least one of the foregoing.

9. The composition of claim 3, wherein the high aspect ratio magnetizable particles and the low aspect ratio magnetizable particles are at a weight ratio of about 1:100 to about 100:1.

10. The composition of claim 1, wherein the carrier fluid is at about 50 to about 95 volume percent based upon the total volume of the magnetorheological fluid composition.

11. A high temperature magnetorheological fluid device operating at a temperature greater than 100° C., the device comprising:

a magnetorheological fluid composition comprising magnetizable particles; and a liquid metal carrier fluid, wherein the liquid metal carrier fluid comprises a metal selected from the group consisting of lithium, sodium, potassium, rubidium, cesium, francium, beryllium, mercury, indium, and tin, a metal alloy, or a solder composition having a melting point from about −40° C. to about 300° C., a boiling point greater than 300° C., and a viscosity greater than about 0.1 centipoise (cp) at the melting point of the liquid based metal carrier fluid.

12. The device of claim 11, wherein the magnetorheological fluid composition is fluidly coupled between at least two rotating members.

13. The device of claim 11, wherein the magnetorheological fluid composition comprises low aspect ratio magnetizable particles, high aspect ratio magnetizable particles, or a combination thereof.

14. A magnetorheological fluid composition comprising:

high aspect ratio magnetizable particles; and a liquid metal carrier fluid comprising gallium.

15. The composition of claim 14, further comprising a soldering flux composition that is liquid at an intended operating temperature.

* * * * *